US008672644B2

(12) United States Patent
Kidd et al.

(10) Patent No.: US 8,672,644 B2
(45) Date of Patent: Mar. 18, 2014

(54) SUPERSONIC EJECTOR PACKAGE

(75) Inventors: Harry Allan Kidd, Shinglehouse, PA (US); Carlos M. Young, Olean, NY (US); Kim M. Carapellatti, Olean, NY (US); Jamieson V. Bowen, Olean, NY (US); Michael J. Bauer, Jamestown, NY (US)

(73) Assignee: Dresser-Rand Company, Olean, NY (US)

( * ) Notice: Subject to any disclaimer, the term of this patent is extended or adjusted under 35 U.S.C. 154(b) by 488 days.

(21) Appl. No.: 12/556,264

(22) Filed: Sep. 9, 2009

(65) Prior Publication Data

US 2010/0108167 A1 May 6, 2010

Related U.S. Application Data

(60) Provisional application No. 61/095,409, filed on Sep. 9, 2008.

(51) Int. Cl.
*F04F 5/00* (2006.01)

(52) U.S. Cl.
USPC ..... 417/174; 417/178

(58) Field of Classification Search
USPC ..... 417/151, 163, 174, 178; 137/819
See application file for complete search history.

(56) References Cited

U.S. PATENT DOCUMENTS

| | | | | | |
|---|---|---|---|---|---|
| 1,437,819 | A | * | 12/1922 | Schmidt | 417/163 |
| 4,237,692 | A | * | 12/1980 | Ahrens et al. | 60/659 |
| 4,395,202 | A | * | 7/1983 | Tell | 417/169 |
| 4,466,778 | A | * | 8/1984 | Volkmann | 417/174 |
| 4,554,956 | A | * | 11/1985 | Greenberg | 141/65 |
| 4,790,054 | A | * | 12/1988 | Nichols | 29/890.142 |
| 4,835,961 | A | | 6/1989 | Presz, Jr. et al. | |
| 5,228,839 | A | * | 7/1993 | Peterson et al. | 417/174 |
| 5,372,005 | A | | 12/1994 | Lawler | |
| 5,628,623 | A | * | 5/1997 | Skaggs | 417/151 |
| 5,884,472 | A | | 3/1999 | Presz, Jr. et al. | |
| 6,347,507 | B1 | | 2/2002 | Lawlor | |
| 6,394,760 | B1 | * | 5/2002 | Tell | 417/174 |
| 6,450,775 | B1 | * | 9/2002 | Hutchinson et al. | 417/198 |
| 6,471,489 | B2 | * | 10/2002 | Hua | 417/198 |
| 6,582,199 | B1 | * | 6/2003 | Volkmann | 417/178 |
| 6,709,630 | B2 | | 3/2004 | Cameron et al. | |
| 6,796,772 | B2 | | 9/2004 | Ikeda et al. | |
| 2004/0105760 | A1 | * | 6/2004 | Eisele et al. | 417/151 |
| 2005/0089408 | A1 | * | 4/2005 | Solomon | 417/182 |
| 2008/0105315 | A1 | * | 5/2008 | Botros et al. | 137/819 |

FOREIGN PATENT DOCUMENTS

WO 2010/030640 A1 3/2010

OTHER PUBLICATIONS

PCT/US2009/056323 Written Opinion dated Nov. 6, 2009 (6 pages).
PCT/US2009/056323 International Preliminary Report on Patentability dated Mar. 24, 2011 (8 pages).

* cited by examiner

*Primary Examiner* — Charles Freay
*Assistant Examiner* — Alexander Comley
(74) *Attorney, Agent, or Firm* — Edmonds & Nolte, PC

(57) ABSTRACT

A supersonic ejector assembly may include a housing manufactured from a solid piece of material, a first ejector assembly positioned in a first bore formed in the housing and secured therein by a first input side flange positioned over an input end of the first bore and an output side flange positioned over an output end of the first bore, and a second ejector assembly positioned in a second bore formed in the housing and secured therein by a second input side flange positioned over an input end of the second bore, the second bore terminating into the first bore proximate a suction input of the first ejector assembly.

19 Claims, 5 Drawing Sheets

SUPERSONIC EJECTOR PACKAGE

CROSS REFERENCE TO RELATED APPLICATION

This application claims the benefit of the filing date of U.S. Patent Application Ser. No. 61/095,409, filed Sep. 9, 2008, the entire disclosure of which is incorporated herein by reference.

FIELD OF THE DISCLOSURE

Embodiments of the disclosure generally relate to a unitary and compact packaging configuration for a supersonic ejector system.

BACKGROUND OF THE DISCLOSURE

Ejectors, sometimes called gas or steam ejectors or venturi ejectors, are generally known in the art. They are commonly used to maintain a vacuum or to compress a gas. The advantage of the ejector over conventional mechanical pumps, such as piston pumps or compressors and diaphragm pumps, is that ejectors have no moving parts and are generally robust (subject to filtering the gas streams to reduce pitting and corrosion). Typically ejectors are subsonic, as supersonic ejectors tend to produce a low pressure exit stream. Additionally supersonic ejectors are generally more sensitive to design/construction parameters for proper operation.

An ejector typically includes an expansion nozzle port through which a motive gas enters the ejector via an inlet port. The gas is expanded to a lower pressure as it passes through a constricted throat section of the expansion nozzle. Generally there is a suction port opening into an enclosed chamber about the expansion nozzle through which the gas to be captured is drawn into the ejector by the pressure differential. Then downstream of the expander there is generally a diffuser section having an inlet, a throat section, and a diverging discharge section.

Conventional subsonic ejectors are commonly used to maintain a vacuum on a system such as disclosed in the following patents: U.S. Pat. No. 5,380,822 discloses the use of a gas, typically steam, ejector to maintain a lower pressure in the later stages of a falling strand devolatilizer than in the down stream condenser to prevent water from freezing; U.S. Pat. No. 6,855,248 teaches the use of a steam ejector to maintain a vacuum on a processing column; U.S. Pat. No. 6,330,821 teaches the use of a gas ejector to maintain a vacuum on a part being tested; U.S. Pat. No. 4,194,924 teaches distilling a carrier solvent and JP-4 in a heated vacuum column in which the vacuum is provided by a gas (steam) ejector; and U.S. Pat. No. 4,834,343 teaches a non flooded treatment column including a venturi device within the top of the column to re-disperse the gas beneath the fluid level. Each of the aforementioned patents is hereby incorporated by reference in their entirety into the present disclosure, to the extent that the aforementioned patents are not inconsistent with the present disclosure.

However, one challenge with the prior art disclosures is the packaging of the ejector systems. More particularly, Applicants have licensed the technology embodied in U.S. patent application Ser. No. 11/809,342 entitled Tandem Supersonic Ejectors (the "'342 application"), which is hereby incorporated by reference in its entirety into the present application. However, in implementing the technology of the '342 application, Applicants have encountered several challenges associated with the size and packaging of the tandem supersonic ejectors. As with the other prior art ejectors noted above, the '342 tandem ejector system is bulky and not desirable for field implementation. As such, there is a need for an efficient, compact, and cost effective supersonic ejector system packaging that is manufactured from a unitary housing, casing, or metal block.

SUMMARY OF THE DISCLOSURE

Embodiments of the disclosure may generally provide a tandem supersonic ejector system packaged in a compact unitary housing.

Embodiments of the disclosure may further provide a tandem supersonic ejector system packaged in a unitary housing. The system may include a first supersonic ejector that receives a compressor discharge at a high pressure input and a compressor gas seal vent line at a low pressure input. A second supersonic ejector may be configured to receive the compressor discharge pressure at a high pressure input and receive the output of the first supersonic ejector at the low pressure input to the second ejector. The output of the second ejector may be communicated to a gas turbine fuel system after being passed through a fuel regulator. Both the first and second supersonic ejectors are contained in a unitary housing that may include a block of metal or alloy material that has been milled, drilled, or otherwise machined to receive the ejectors and associated conduits therein. The resulting size of the block of metal containing the ejectors will generally be about 12×12×5 inches.

Embodiments of the disclosure may further provide a tandem supersonic ejector system that includes a block of metal or an alloy that has a first bore formed there through, where the first bore extends substantially through the block and is sized to receive a first ejector therein. The block further includes a second bore formed therein, where a first end of the second bore originates proximate an outer edge of the block and a second end of the second bore terminates proximate the first bore and is in communication therewith. The second bore may be sized to receive a second supersonic ejector therein. The originating ends of the bores for the first and second ejectors may include fittings threadably secured to the block, and where the fittings are configured to engage pipe flanges. With regard to the block, the length and width of the block may be between about 8 inches and about 16 inches, and the height between about 2½ inches and about 6½ inches.

Embodiments of the disclosure may further provide a supersonic ejector assembly. The assembly may include a housing manufactured from a solid piece of material, a first ejector assembly positioned in a first bore formed in the housing and secured therein by a first input side flange positioned over an input end of the first bore and an output side flange positioned over an output end of the first bore, and a second ejector assembly positioned in a second bore formed in the housing and secured therein by a second input side flange positioned over an input end of the second bore, the second bore terminating into the first bore proximate a suction input of the first ejector assembly.

Embodiments of the disclosure may further provide a tandem supersonic ejector package that includes a first supersonic ejector assembly positioned in a first bore formed into a unitary housing, and a second supersonic ejector assembly positioned in a second bore formed into the unitary housing, wherein an output of the second supersonic ejector assembly is in communication with a suction input of the first supersonic ejector assembly.

Embodiments of the disclosure may further provide a tandem supersonic ejector package. The package may include a unitary metal or metal alloy block having the following bores formed therein: a first longitudinal bore formed through the block; a second longitudinal bored formed into the block and terminating into the first longitudinal bore; and a third longitudinal bore formed into the block and terminating into the second longitudinal bore. The package may further include a first supersonic ejector assembly positioned in the first longitudinal bore, and a second supersonic ejector assembly positioned in the second longitudinal bore, wherein a suction input of the first supersonic ejector assembly is in communication with terminating end of the second longitudinal bore, and a suction input of the second supersonic ejector assembly is in communication with the terminating end of the third longitudinal bore.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
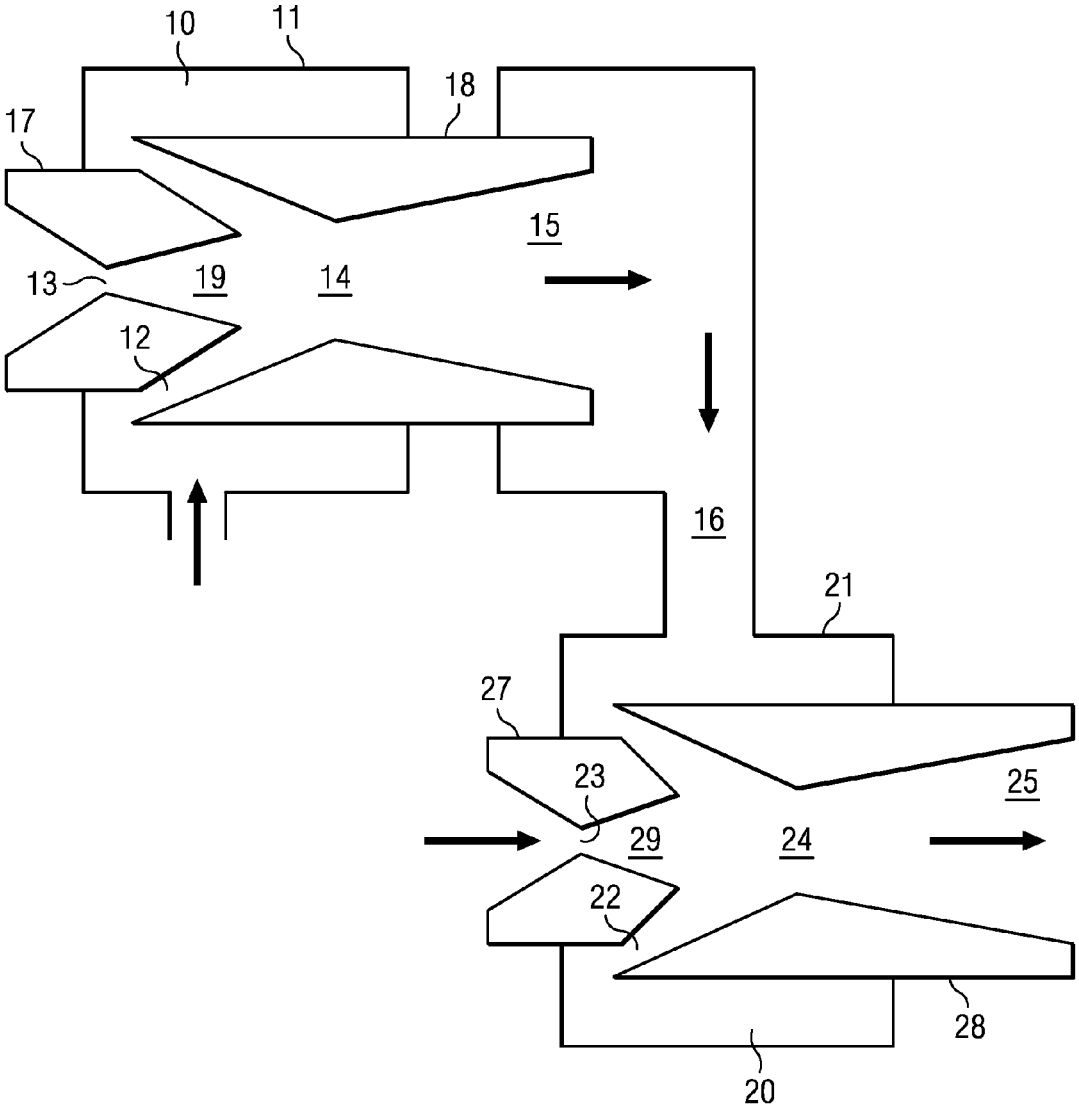
FIG. 1 illustrates a schematic sectional drawing of tandem supersonic ejectors.

It is to be understood that the following disclosure provides several exemplary embodiments for implementing different features, structures, or functions of the disclosure. Exemplary embodiments of components, arrangements, and configurations are described below to simplify the present disclosure, however, these exemplary embodiments are provided merely as examples and are not intended to be limiting on the scope of the disclosure. Additionally, the present disclosure may repeat reference numerals and/or letters in the various exemplary embodiments and across the Figures provided herein. This repetition is for the purpose of simplicity and clarity and does not in itself dictate a relationship between the various embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one embodiment may be used in any other embodiment, without departing from the intent of the disclosure.

Additionally, certain terms are used throughout the following description and claims to refer to particular components. As one skilled in the art will appreciate, various entities may refer to the same component by different names, and as such, the naming convention for the elements described herein is not intended to be limiting upon the scope of the disclosure, unless otherwise specifically defined herein. Further, the naming convention used herein is not intend to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values. Accordingly, various embodiments of the disclosure may deviate from the numbers, values, and ranges disclosed herein without departing from the intended scope of the disclosure.

FIG. 1 illustrates a schematic sectional drawing of an exemplary tandem supersonic ejector system. In FIG. 1 there are two supersonic ejectors 10, and 20 in tandem. The first supersonic ejector includes an enclosure 11, which is airtight or substantially airtight that includes a suction port 12. The suction port 12 of the first supersonic ejector 10 may be annular, or any other shape that facilitates the desired flow path characteristics for the ejector suction port 12. The motive gas enters the nozzle 17 of the first supersonic ejector, is expanded through a constricted throat 13, and is further expanded through the diverging section of the nozzle to a much lower pressure and a supersonic velocity. This supersonic velocity motive gas exits nozzle 17 at exit 19 of the first supersonic ejector 10 and the resulting reduction in the pressure draws the off gas into the ejector through the suction port 12. The combined motive gas and the off gas proceed to a diffuser 18 of the first supersonic ejector 10 having a larger throat 14 than that of the nozzle 17. The cross sectional area of the throat 14 of the diffuser 18 of the first ejector 10 is larger in size than the cross sectional area of the throat 13 of the nozzle 17. Due to the converging and then diverging sections of the cross section area of the channel through the diffuser 18 the speed of the motive gas and entrained off gas decreases. The mixture of the motive gas and the off gas exits the ejector 10 at a discharge end 15 of the diffuser 18 at higher pressure than that of the off gas.

The end of the diffuser 18 exits into a conduit 16 leading to an enclosure 21, which is air tight or substantially air tight, that includes a suction port 22 of the second supersonic ejector 20. The suction port 22 of the second supersonic ejector 20 may be annular. The motive gas enters a nozzle 27 of the second supersonic ejector 20 and proceeds to a constricted throat 23, is expanded through the diverging section of the nozzle 27 and exits the nozzle 27 at an exit 29 and proceeds to diffuser 28 having a larger throat 24 than throat 23 of nozzle 27. The cross sectional area of the channel through the second supersonic ejector 20 also increases in size from throat 23 of the nozzle 27 to the throat 24 of the diffuser 28. This increases the velocity of the motive gas as it passes through throat 23 and the diverging section of the nozzle 27 and reduces the pressure drawing the exit gas from the first supersonic ejector 10 passing through the conduit 16 into the ejector 20 through suction port 22. Due to the converging and diverging cross section areas of the channel through the diffuser the speed of the motive gas and entrained off gas decreases in the diffuser. The mixture of the motive gas and the gas in the conduit 16 exits the ejector 20 at a discharge end 25 of the diffuser 28. The discharge end 25 of the diffuser 28 of the second supersonic ejector 20 feeds a conduit, which may be a pipe or other gas communicating line to recirculate the off gas combined with the motive gas for further processing.

In operation a motive gas at a higher pressure than the off gas, in the case of a pipeline the natural gas within the line, and in the case of a chemical plant the process steam, is injected into the nozzle 17 of the first supersonic ejector 10. The cross sectional area of the ejector 10 narrows to a throat section 13 of the first supersonic ejector 10. This increases the velocity of the gas as it passes through the throat 13 and continues to expand through the diverging section of the nozzle 17 to the exit 19, which creates a lower pressure at the suction inlet 12 of the first supersonic ejector 10. This draws the off gas within the enclosure 11 into the first supersonic ejector. The off gas is drawn into and entrained with the motive gas passing through the first supersonic ejector 10. Downstream the cross sectional area of the throat 14 of the diffuser 18 is larger than the throat 13 of the nozzle 17. The diffuser 18 expands to the discharge end 15 or is fed to the suction port 22 for the second supersonic ejector 20. A second motive gas is fed to the nozzle 27 of the second supersonic ejector 20, which narrows to the throat 23. The gas velocity increases and the pressure drops drawing the off gas into the nozzle and leaves at the exit 29. The cross sectional area of the second supersonic ejector 20 also increases to the throat 24 of the diffuser 28 and then further expands to the discharge end 25. The discharge end 25 then feeds a line (not shown) which directs the recompressed off gas to subsequent processing at a higher pressure.

In another exemplary embodiment of the disclosure, the nozzles 17 and 27 of the supersonic ejectors 10, 20 are adjustable relative to the diffusers 18 and 28. Typically this is done by having the nozzle 17, 27 threaded and mounted on receiving threads on the enclosure or on a portion of the inlet to the diffuser 18, 28 in a manner not to close the suction port. The ejectors 10, 20 may be designed so that the first supersonic ejector 10 is operated at an exit Mach number from about 2.4 to about 2.6 and the second supersonic ejector 20 is operated at an exit Mach number from about 1.6 to about 1.8. In the first supersonic ejector 10, the ratio of the cross section area of the nozzle exit 19 to the nozzle throat 13 may be from about 2.9 to about 3.2, preferably from about 3.0 to about 3.1. In the second supersonic ejector 20, the ratio of the cross section area of the nozzle exit 29 to the nozzle throat 23 may be from about 1.30 to about 1.45, preferably from about 1.35 to about 1.40. The ratio of the area of the throat 14 of the diffuser 18 to the throat 13 of the nozzle 17 of the first supersonic ejector 10 may range from about 4.60 to about 4.90, preferably from 4.70 to 4.80. The ratio of the area of the throat 24 of the diffuser 28 to the throat 23 of the nozzle 27 of the second supersonic ejector 20 may range from about 1.70 to about 1.90, preferably from about 1.80 to about 1.90. Typically the ratio of the motive gas flow rate to the first supersonic gas ejector to the off gas flow rate is from about 32 to about 45. (e.g. either g per g or Kg per Kg as this is a unitless ratio). Typically the ratio between the motive gas flow rate to the second supersonic gas ejector and the discharge flow from the first supersonic ejector is from about 20 to about 25.

Figure 3:
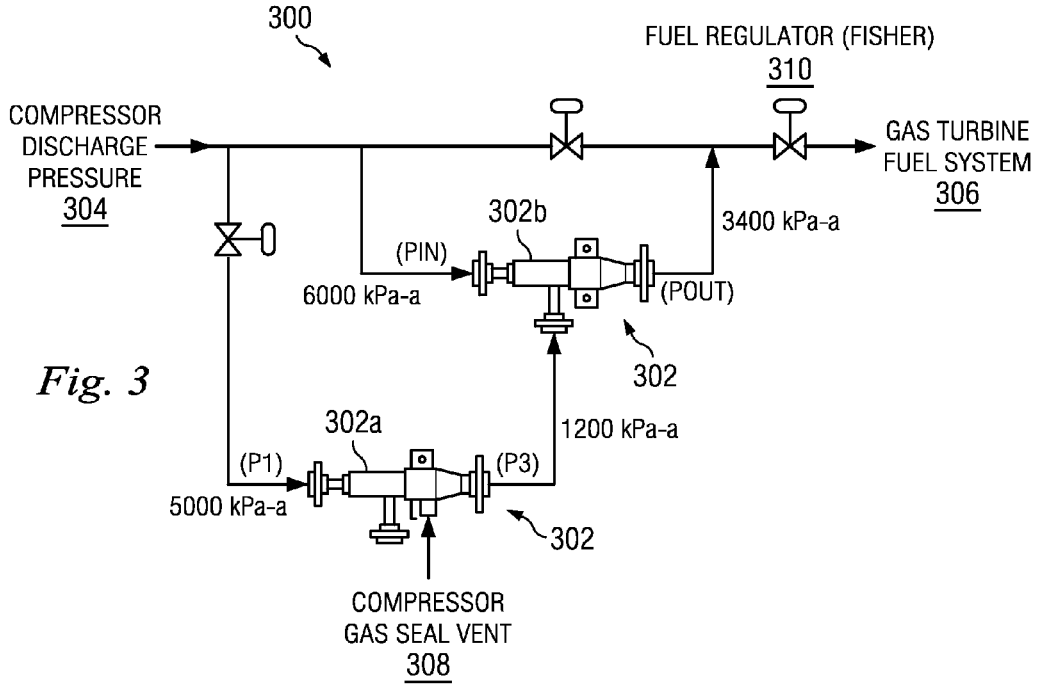
FIG. 3 illustrates an exemplary schematic configuration of an implementation of a tandem supersonic ejector system of the disclosure.
Figure 4:
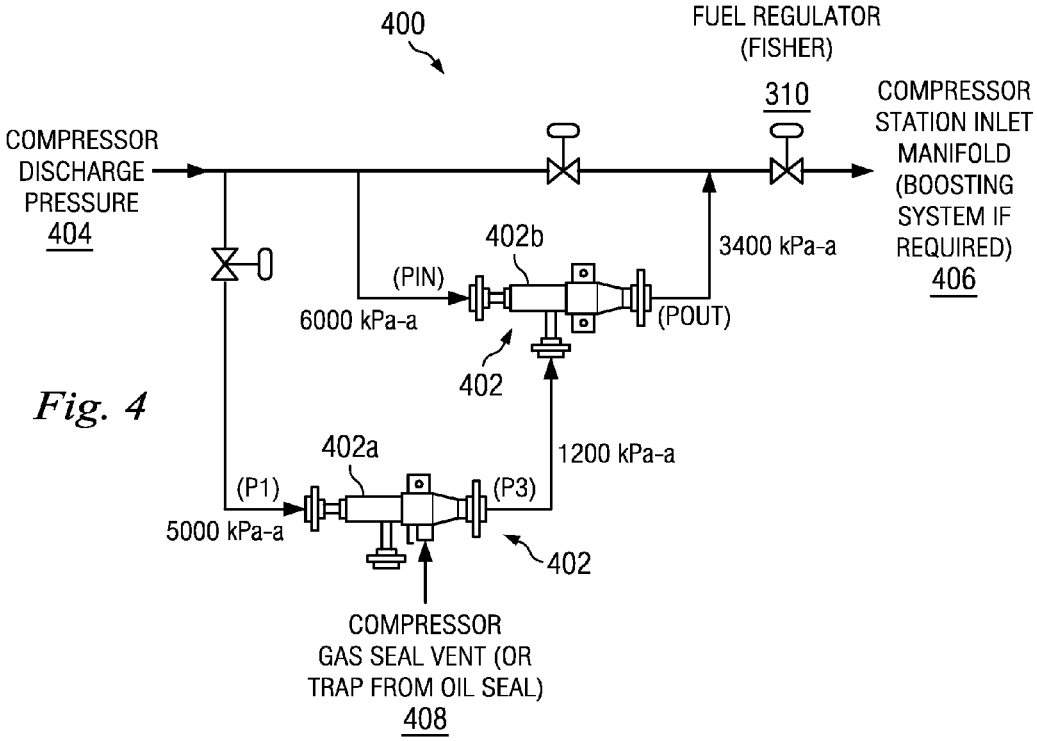
FIG. 4 illustrates another exemplary schematic configuration of an implementation of a tandem supersonic ejector system of the disclosure.

Without being bound by theory, the one-dimensional governing equations for the isentropic expansion of gas through a converging-diverging supersonic nozzle can be written as shown in U.S. patent application Ser. No. 11/809,342 (the "'342 application"). Additionally, FIG. 2 of the '342 application illustrates Mach number contours at the exit of a supersonic nozzle and diffuser; FIG. 3 of the '342 application illustrates Stagnation Pressure Contours at Exit of Supersonic Nozzle and Diffuser; FIG. 4 of the '342 application illustrates the overall performance of the two-Stage Supersonic Ejector, FIG. 5 of the '342 application illustrates overall performance of the two-Stage Supersonic Ejector; and FIG. 6 of the '342 application illustrates overall performance of the two-Stage Supersonic Ejector. Each of these Figures and the accompanying description are hereby incorporated by reference into the present disclosure, to the extent that the incorporated subject matter is not inconsistent with the present disclosure.

Figure 2:
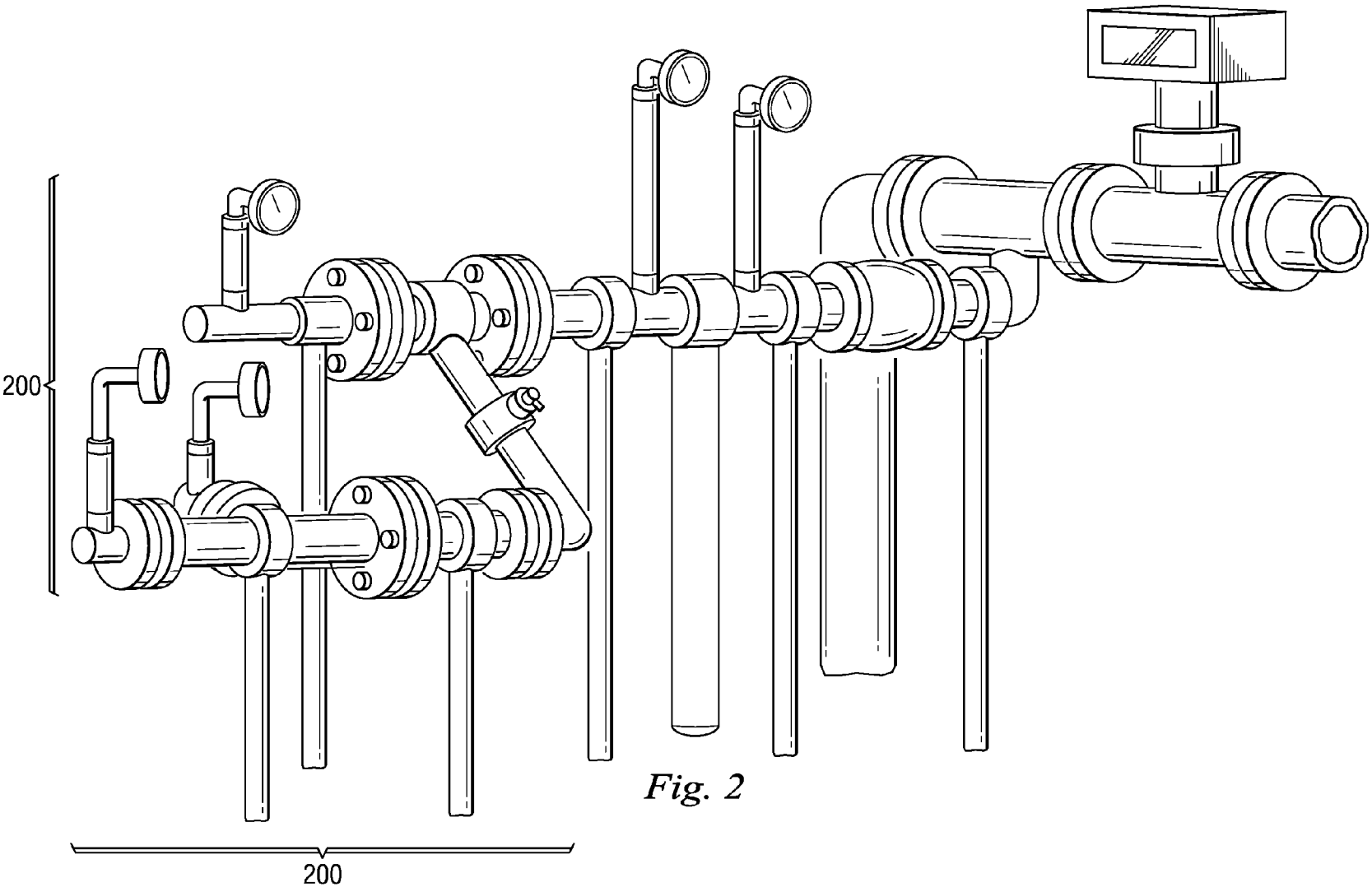
FIG. 2 illustrates a tandem supersonic ejector system implementation in a gas plant, where the system is not in a unitary housing.

FIG. 2 illustrates a tandem supersonic ejector system implementation in a gas plant, where the system is not in a unitary housing. The exemplary tandem supersonic ejector system shown in FIG. 2 illustrates the relative size of a tandem ejector system. For example, although the two ejectors, which are illustrated by brackets 200, are compactly assembled, the tandem ejector system illustrated in FIG. 2 nonetheless encompasses between about 24 and about 36 inches in width, between about 20 and about 30 inches in height, and between about 12 and about 20 inches in depth. Furthermore, these dimensions only include the tandem ejectors, and do not include the subsequent valving illustrated in FIG. 2.

FIG. 3 illustrates an exemplary schematic configuration of an implementation of a tandem supersonic ejector system 300 of the disclosure. The system 300 generally includes tandem supersonic ejectors 302*a*, 302*b*. The first ejector 302*a* may receive a compressor discharge pressure 304 at a high pressure input and a compressor gas seal vent 308 at a low pressure input. The output of the first ejector 302*a* may be communicated to a low pressure input of a second ejector 302*b*, and a regulated compressor discharge pressure 304 may be provided to the high pressure input of the second ejector 302*b*. The output of the second ejector 302*b* may be communicated to a gas turbine fuel system 306. Thus, the compressor gas seal vent 308, which would normally be vented to the atmosphere, is mixed in with the gas turbine fuel system 306 input via the tandem supersonic ejectors of the present disclosure.

FIG. 4 illustrates another exemplary schematic configuration of an implementation of a tandem supersonic ejector system 400 of the disclosure. The tandem ejector system 400 may be configured to receive a compressor discharge pressure 404 at a high-pressure input for each of two supersonic ejectors 402. The first supersonic ejector 402*a* may be configured to receive a compressor gas seal vent or a trap from an oil seal at a low pressure input 408. The output of the first supersonic ejector 402*a* may be communicated to a low pressure input of the second supersonic ejector 402*b*. The output of the second supersonic ejector 402*b* may be communicated to a compressor station inlet manifold 406 (or boosting system if required).

In another exemplary embodiment, the tandem supersonic ejector systems can be combined with other ejector systems, including other tandem ejector systems, to form a series or chain of ejector systems. In other embodiments of the disclosure, the number of ejectors in the system may be increased to 3, 4, 5, or more ejectors in a similar configuration as disclosed in at least one of the embodiments presented herein. Thus, the tandem configuration may be expanded to include between 3 and about 6 or more supersonic ejectors.

Figure 5:
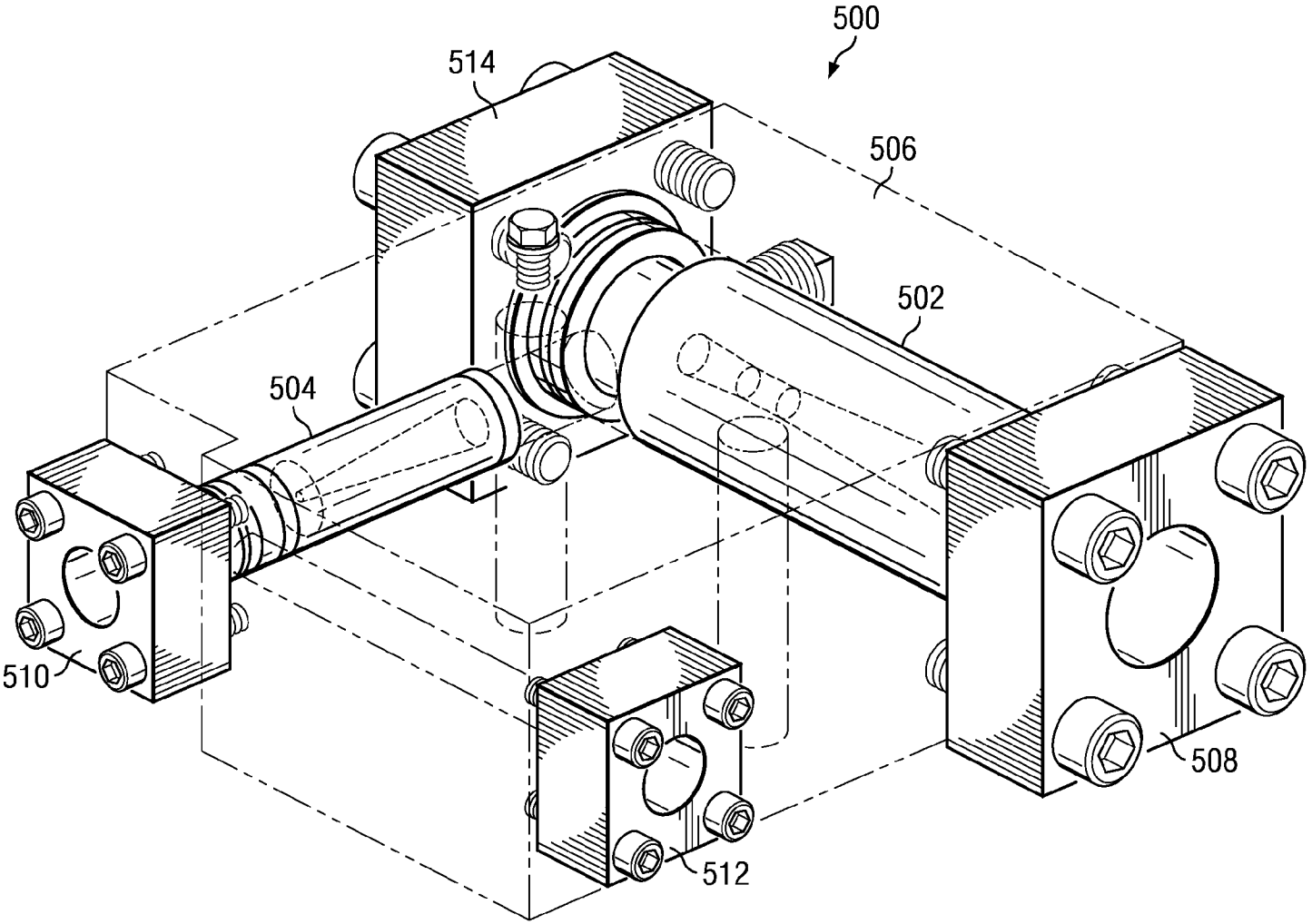
FIG. 5 illustrates an exemplary tandem supersonic ejector system manufactured in a unitary housing.

FIG. 5 illustrates an exemplary tandem supersonic ejector system manufactured assembled in a unitary housing. The exemplary system 500 includes a unitary housing 506, which may be a single block of metal that has been machined and/or drilled out to receive the tandem supersonic ejectors therein. The metal may be any rigid metal such as iron based metals, titanium, aluminum, or any alloy metal commonly used in the compressor or turbine valve or piping arts. The outer surface of the housing 506 may include a plurality of connection flanges configured to receive or otherwise connect to piping for inputs and outputs. More particularly, flange 508 may be configured to connect to a high pressure input to a first supersonic ejector 502. Flange 514 may be configured to connect to the output line for the first supersonic ejector 502. Flange 510 may be configured as a high pressure input for a second supersonic ejector 504, and flange 512 may be configured as a low-pressure suction input for the second supersonic detector 504. The output of the second ejector 504 may be communicated to a low pressure input of the first ejector 502, thus forming the tandem ejector configuration of system 500.

Figure 6:
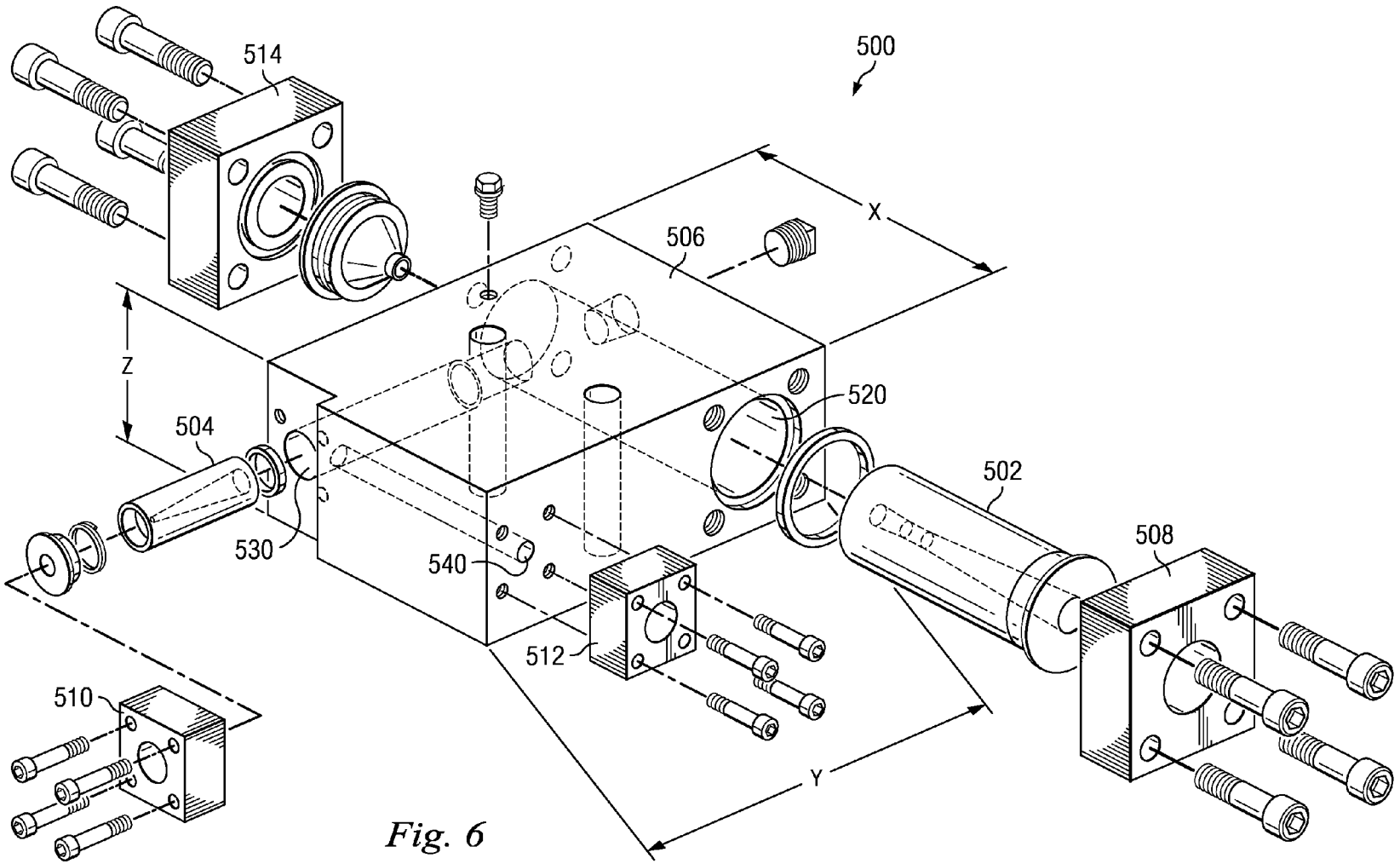
FIG. 6 illustrates a partially exploded view of an exemplary tandem supersonic ejector system manufactured in a unitary housing.

FIG. 6 illustrates a partially exploded view of an exemplary tandem supersonic ejector system manufactured in a unitary housing. The exploded view illustrates the unitary block of metal that may be used to form the housing 506 for the exemplary ejector system. More particularly, the exploded view of FIG. 6 clearly illustrates that a plurality of bores may be formed in the unitary block housing 506 to form the unitary casing within which the supersonic ejectors may be contained. For example, a first bore 520 may be formed longitudinally through the block 506, and the first bore 520 may be configured to receive the first ejector 502 therein. Similarly, a second bore 530 may be formed in the block 506 and configured to receive the second ejector 504 therein. Further, the second bore 530 may be positioned to terminate into the first bore 520, and as such, the output of the first ejector 504 may be communicated to the low-pressure suction input of the second ejector 502. Additionally, a third bore 540 may be formed in the block 506, and the third bore may be configured to terminate in the second bore 530, and as such, the third bore 540 may be used to communicate with the low-pressure suction input of the second ejector 504. Applicants note that although each of the component containing bores illustrated in the Figures are all at right angles to each other, embodiments of the disclosure are not limited to any particular configuration or arrangement of bores. For example, each of the respective bores may be formed into the block housing in a configuration where each of the bores is parallel to each other. Alternatively, the respective bores may be positioned such that the angle between the respective bores is between 0° and about 180°. Additional threaded bores may be formed at various locations in the block 506 to secure the various flanges 514, 508, 512, 510 to the block 506.

In each of the exemplary ejector systems illustrated in FIGS. 5 and 6, the bores may be formed with threaded interior walls on the bores formed therein. As such, the respective ejector assemblies or components thereof may be configured with threaded outer walls, such that the ejector assemblies or components may be threaded into the unitary block housing to form the desired system. In other embodiments the ejector assemblies may be sized and shaped to be slidably received and secured into a bore formed in the main body 506. In this embodiment there will generally be a securing mechanism configured to maintain the ejector assemblies in the respective bores at the desired position. For example, the exemplary embodiments illustrated in FIGS. 5 and 6 use the flanges 508, 510, 512, 514 bolted to the main body 506 to secure the ejector assemblies in their respective bores. Although the bolted flanges 508, 510, 512, 514 are illustrated in the exemplary embodiments shown herein, Applicants appreciate that other equally effective methods for securing the ejector assemblies in their respective bores may be used without departing from the scope of the disclosure. Further, it should be noted that the ejector assemblies may include any number of the ejector components, and as such may include a full ejector or a partial ejector. In embodiments where the assembly includes only a partial assembly, generally the remaining components of the ejector may be preformed into the housing, i.e., permanently drilled or otherwise machined into the housing 506.

Referring still to the exemplary system 500 illustrated in FIGS. 5 and 6, Applicant's note that by utilizing the unitary housing 506, the overall size of the ejector system 500 is substantially reduced. For example, the x and y dimensions illustrated on FIG. 6 may be between about 8, 10, or 12 inches and about 12, 14, or 16 inches for each of the embodiments of the tandem supersonic ejector system disclosed herein. Further, the z dimension may be between about 2½ inches and about 6½ inches for each of the embodiments of the tandem supersonic ejector system disclosed herein. As such, by forming the tandem supersonic ejectors system in a unitary housing 506, Applicants have reduced the size of the tandem supersonic ejector system by more than 200%. Further, manufacturing the tandem supersonic ejectors system from a unitary block of steel substantially reduces manufacturing costs and maintenance issues, while improving the reliability of the system.

In each of the above noted exemplary embodiments, the ejector assemblies may be manufactured from a metal or metal alloy. The metal or metal alloy may be selected for the specific application, i.e., for temperature, strength, or chemical reactivity considerations that accompany each application. Regardless, exemplary materials that may be used to manufacture the ejector assemblies include metals, iron, steel, titanium, and various alloys of these materials with additional elements added thereto. In at least one exemplary embodiment the ejectors may be manufactured from a non-metallic material, such as a ceramic or other rigid non-metallic material. Similarly, the housing may also be manufactured from the same exemplary materials as the ejector assemblies. However, in selecting the appropriate material for the respective elements, the ability of the material to be precisely machined is a primary factor.

Embodiments of the disclosure may generally provide a tandem supersonic ejector system. The system may include a first supersonic ejector that receives a compressor discharge at a high pressure input and a compressor gas seal vent line at a low pressure input. A second supersonic ejector may be configured to receive the compressor discharge pressure at a high pressure input and receive the output of the first supersonic ejector at the low pressure input to the second ejector. The output of the second ejector may be communicated to a gas turbine fuel system after being passed through a fuel regulator. Both the first and second supersonic ejectors are contained in a unitary housing that comprises a block of metal that has been milled or drilled to receive the ejectors therein. The resulting size of the block of metal containing the ejectors will generally be about 12×12×5 inches.

Embodiments of the disclosure may further provide a tandem supersonic ejector system that includes a block of metal or an alloy that has a first bore formed therethrough, where the first bore extends substantially through the block and is sized to receive a first ejector therein. The block further includes a second bore formed therein, where a first end of the second bore originates proximate an outer edge of the block and a second end of the second bore terminates proximate the first bore and is in communication therewith. The second bore may be sized to receive a second supersonic ejector therein. The originating ends of the bores for the first and second ejectors may include fittings threadably secured to the block, and where the fittings are configured to engage pipe flanges. With regard to the block, the length and width of the block may be between about 8 inches and about 16 inches, and the height between about 2½ inches and about 6½ inches.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim as follows:

1. A supersonic ejector assembly comprising:

a housing machined from a solid piece of material;

a first bore formed through the housing;

a second bore formed in the housing and not coaxially aligned with the first bore;

a first ejector assembly positioned in the first bore formed in the housing and secured therein by a first input side flange positioned over an input end of the first bore and an output side flange positioned over an output end of the first bore;

a second ejector assembly positioned in the second bore formed in the housing and secured therein by a second input side flange positioned over an input end of the second bore, the second bore terminating into the first bore proximate a suction input of the first ejector assembly; and a third bore formed in the housing, an output end of the third bore being in communication with a suction input of the second ejector assembly, and an input end of the third bore being in communication with an outer surface of the housing, the housing having a connection flange attached thereto and positioned over the input end of the third bore, and the second bore being formed in the housing between the first bore and the third bore and being configured to provide a communication between the first bore and the third bore.

2. The supersonic ejector assembly of claim 1, wherein the input end of the first bore is in communication with a first constricted throat of the first ejector assembly and the input end of the second bore is in communication with a second constricted throat of the second ejector assembly.

3. The supersonic ejector assembly of claim 1, wherein an output of the second ejector is in communication with the suction input of the first ejector assembly.

4. The supersonic ejector assembly of claim 1, wherein the first input side flange and the second input side flange are in communication with a compressor discharge pressure, a suction input for the second ejector assembly is in communication with a compressor gas seal vent, and the output of the first ejector assembly is in communication with a gas turbine fuel system.

5. The supersonic ejector assembly of claim 1, wherein the first input side flange and the second input side flange are in communication with a compressor discharge pressure, a suction input for the second ejector assembly is in communication with a compressor gas seal vent or a trap from a compressor oil seal, and the output of the first ejector assembly is in communication with a compressor station inlet manifold system.

6. The supersonic ejector assembly of claim 1, wherein the housing has a length of less than about 12 inches, a width of less than about 12 inches, and a height of less than about 5 inches.

7. The supersonic ejector assembly of claim 1, wherein the housing has a length and width of between about 8 inches and about 16 inches and a height of between about 2½ inches and about 6½ inches.

8. The supersonic ejector assembly of claim 1, wherein the first and second ejector assemblies are manufactured from a metal, a metal alloy, or a ceramic material.

9. The supersonic ejector assembly of claim 1, wherein the housing comprises a unitary block of metal or a metal alloy having the first, second, and third bores formed therein.

10. A tandem supersonic ejector package, comprising:

a unitary housing defining a first bore, a second bore, and a third bore;

a first supersonic ejector assembly positioned in the first bore; and a second supersonic ejector assembly positioned in the second bore, wherein the second bore is not coaxially aligned with the first bore, the second bore is defined in the unitary housing between the first bore and the third bore, and is configured to provide a communication between the first bore and the third bore, an output of the second supersonic ejector assembly is in communication with a suction input of the first supersonic ejector assembly, and an output end of the third bore is in communication with a suction input of the second supersonic ejector assembly, and an input end of the third bore is in communication with an outer surface of the unitary housing, the unitary housing having a connection flange attached thereto and positioned over the input end of the third bore.

11. The tandem supersonic ejector package of claim 10, wherein an output end of the second bore terminates into the suction input of the first supersonic ejector assembly.

12. The tandem supersonic ejector package of claim 10, wherein a compressor discharge pressure line is in communication with respective inputs of the first and second supersonic ejector assemblies.

13. The tandem supersonic ejector package of claim 12, wherein the suction input of the second supersonic ejector assembly is in communication with a compressor gas seal vent line or a trap line from a compressor oil seal.

14. The tandem supersonic ejector package of claim 10, wherein the unitary housing has a length of less than about 12 inches, a width of less than about 12 inches, and a height of less than about 5 inches, or wherein the unitary housing has a length and width of between about 8 inches and about 16 inches and a height of between about 2½ inches and about 6½ inches.

15. The tandem supersonic ejector package of claim 10, wherein the first and second ejector assemblies are manufactured from a metal, a metal alloy, or a ceramic material, and wherein the unitary housing comprises a unitary block of metal or a metal alloy having the first, second and third bores formed therein.

16. The tandem supersonic ejector package of claim 10, wherein the first and second supersonic ejector assemblies are configured to receive an input pressure of about 5000 kPa to about 6000 kPa.

17. A tandem supersonic ejector package, comprising:

a unitary metal or metal alloy block having the following bores formed therein:

a) a first longitudinal bore formed through the block;

b) a second bore formed into the block and terminating into the first longitudinal bore, wherein the second bore is not coaxially aligned with the first longitudinal bore; and c) a third bore formed into the block and terminating into the second bore;

a first supersonic ejector assembly positioned in the first longitudinal bore; and a second supersonic ejector assembly positioned in the second bore, wherein a suction input of the first supersonic ejector assembly is in communication with the terminating end of the second bore, and a suction input of the second supersonic ejector assembly is in communication with the terminating end of the third bore, wherein an input end of the third bore is in communication with an outer surface of the unitary metal or metal alloy block, the unitary metal or metal alloy block having a connection flange attached thereto and positioned over the input end of the third bore, and wherein the second bore is formed between the first longitudinal bore and the third bore and is configured to provide a communication between the first longitudinal bore and the third bore.

18. The tandem supersonic ejector package of claim 17, wherein the unitary metal or metal alloy block has a length of less than about 12 inches, a width of less than about 12 inches, and a height of less than about 5 inches, or wherein the unitary metal or metal alloy block has a length and width of between about 8 inches and about 16 inches and a height of between about 2½ inches and about 6½ inches.

19. The tandem supersonic ejector package of claim 17, wherein a compressor discharge pressure line is in communication with respective inputs of the first and second supersonic ejector assemblies, and wherein the suction input of the second supersonic ejector assembly is in communication with a compressor gas seal vent line or a trap line from a compressor oil seal.

* * * * *